US008710722B2

(12) United States Patent
Totani

(10) Patent No.: US 8,710,722 B2
(45) Date of Patent: Apr. 29, 2014

(54) LED LAMP INCLUDING HEAT DISSIPATOR

(71) Applicant: Beat-Sonic Co., Ltd., Nisshin (JP)

(72) Inventor: Tsutomu Totani, Nisshin (JP)

(73) Assignee: Beat-Sonic Co., Ltd., Aichi (JP)

( * ) Notice: Subject to any disclaimer, the term of this patent is extended or adjusted under 35 U.S.C. 154(b) by 0 days.

(21) Appl. No.: 13/787,966

(22) Filed: Mar. 7, 2013

(65) Prior Publication Data

US 2013/0257259 A1 Oct. 3, 2013

(30) Foreign Application Priority Data

Mar. 29, 2012 (JP) ..... 2012-075875

(51) Int. Cl.
*H01J 1/02* (2006.01)
*H01J 7/24* (2006.01)

(52) U.S. Cl.
USPC ..... 313/46; 313/11; 313/39; 313/42; 313/45

(58) Field of Classification Search
None
See application file for complete search history.

(56) References Cited

U.S. PATENT DOCUMENTS

| | | | | |
|---|---|---|---|---|
| 8,382,328 | B2 * | 2/2013 | Hsu | 362/277 |
| 2011/0194288 | A1 * | 8/2011 | Hsu | 362/282 |
| 2013/0076223 | A1 * | 3/2013 | Totani | 313/46 |

FOREIGN PATENT DOCUMENTS

| | | | |
|---|---|---|---|
| JP | 2009004698 A | * | 1/2009 |
| JP | 2010040364 A | * | 2/2010 |
| JP | 2011126262 A | * | 6/2011 |

* cited by examiner

*Primary Examiner* — Natalie Walford
(74) *Attorney, Agent, or Firm* — Posz Law Group, PLC

(57) ABSTRACT

An LED lamp includes a heat dissipator, a cap, a module substrate fixed to an end of the heat dissipator and on which an LED chip is mounted, a light diffusing member mounted on an end surface of the heat dissipater so as to be located opposite the LED chip, a lighting circuit incorporated in the heat dissipator, and a glass block having an open end and formed with a recess. The light diffusing member is accommodated in the recess of the block through the open end of the glass block, and the heat dissipator is secured to the block so that the heat dissipator and the cap are exposed outside the block. When the block is placed on a placement surface, the LED lamp stands by itself by weight of the block in such a manner that the cap is prevented from contacting the placement surface.

6 Claims, 5 Drawing Sheets

LED LAMP INCLUDING HEAT DISSIPATOR

CROSS-REFERENCE TO RELATED APPLICATIONS

This application is based upon and claims the benefit of priority from the prior Japanese Patent Application No. 2012-075875 filed on Mar. 29, 2012, the entire contents of which are incorporated herein by reference.

BACKGROUND

1. Technical Field

The present disclosure relates to an LED lamp incorporating an LED chip serving as a light source.

2. Related Art

LED lamps using LED chips as a light source having far less power consumption have recently been commercially available in markets. One of types of LED lamps generally includes a metal heat dissipator made of a metal, such as aluminum, having high heat conductivity, a cap mounted to an end of the heat dissipator, a module substrate on which an LED chip is mounted, a glove having a semispherical top and made of translucent glass or plastic material and a lighting circuit which supplies electric power to the LED chip. The module substrate is fixed to an end of the heat dissipator located opposite the cap. The glove is mounted to the heat dissipator so as to cover the module substrate. The lighting circuit is incorporated in the heat dissipator. The lighting circuit is electrically connected to the cap and further to the module substrate. This type of LED lamp is disclosed by Japanese Patent Application Publication Nos. JP-A-2011-70972, JP-A-2011-82132, JP-A-2011-90828 and JP-A-2011-91033.

The aforementioned LED lamp is used as a substitute for incandescent lamps substantially solely and its use is accordingly limited. The LED chip serving as the light source for the LED lamp has an exceedingly lower calorific value during its turn-on time as compared with the filament. Accordingly, the temperature of the heat dissipator rises only to about several dozen degrees at the highest during the turn-on time of the LED chip. Thus, the LED lamp has such a characteristic that the temperature thereof is low such that the LED lamp can be touched during its turn-on time.

SUMMARY

The inventor focused attention on a low heat buildup of the LED chip, and an object of the disclosure is to provide an LED lamp which can provide new use applications by making use of the low heat buildup.

The present disclosure provides an LED lamp comprising a heat dissipator, a cap fixed to an end of the heat dissipator, a module substrate which is fixed to an end of the heat dissipator and on which an LED chip is mounted, said end to which the module substrate is fixed being located opposite the cap, a light diffusing member which is mounted on an end surface of the heat dissipator so as to be located opposite the LED chip, the light diffusing member peripherally diffusing light emitted by the LED chip, a lighting circuit which is incorporated in the heat dissipator to supply electric power to the LED chip, the lighting circuit being electrically connected to each one of the cap and the module substrate, and a glass block having an open end and formed with a recess. The light diffusing member is accommodated in the recess of the glass block through the open end of the glass block, and the heat dissipator is secured to the block so that the heat dissipator and the cap are exposed outside the block. When the block is placed on a placement surface for the LED lamp, the LED lamp stands by itself under weight of the block in such a manner that the cap is prevented from contacting the placement surface.

According to the above-described LED lamp, when the block is placed on the placement surface for the LED lamp, the LED lamp stands by itself under weight of the block in such a manner that the cap is prevented from contacting the placement surface. Upon energization of the lighting circuit via the cap, the LED chip emits light. The light emitted by the LED chip is diffused around by the light diffusing member accommodated in the recess. The diffused light passes through the glass block, illuminating a region around the block.

Since the LED chip has an exceedingly lower calorific value during turn-on, there is no possibility that the surface of a floor or table or a rug on the floor or table would be damaged by heat generated by the LED chip. Consequently, the LED lamp can be used as interior lighting equipment when placed on the floor, table or a rack to be caused to stand by itself.

In one embodiment, the block has an underside which is formed to be flat so that the LED lamp stands by itself when the underside of the block is placed on the placement surface. According to the embodiment, since the underside of the block is formed to be flat, the LED lamp can stably stand by itself when placed on the placement surface. This can expand use applications of the LED lamp.

In another embodiment, the underside of the block is gently curved outward so that the LED lamp stands by itself while the block is substantially in a one-point contact with the placement surface of the LED lamp when the underside of the block is placed on the placement surface. According to the embodiment, since the block is substantially in a one-point contact with the placement surface of the LED lamp, the LED lamp can stand by itself so as to be swingable in a front-back direction and in a right-left direction about the contact point. A dynamic illumination effect can be achieved when the LED lamp is swung. This can further expand use applications of the LED lamp as interior accessory.

In further another embodiment, the block is filled with gas bubbles therein. In this case, light emitted by the LED chip is diffused by the light diffusing member thereby to be irregularly reflected on the bubbles in the block when passing through the block. This can improve the illumination effect.

In further another embodiment, the block has a surface formed with a number of facets. In this case, when light emitted by the LED chip is diffused by the light diffusing member to pass through the block, the facets of the block are shining. This can improve the illumination effect.

In further another embodiment, the block has a surface roughened so that light emitted by the LED chip is diffusely reflected on the surface of the block. According to the embodiment, when emitted by the LED chip and diffused by the diffusing member to pass through the block, light is irregularly diffused on the roughened surface of the block. This can improve the illumination effect.

DETAILED DESCRIPTION

Figure 1:
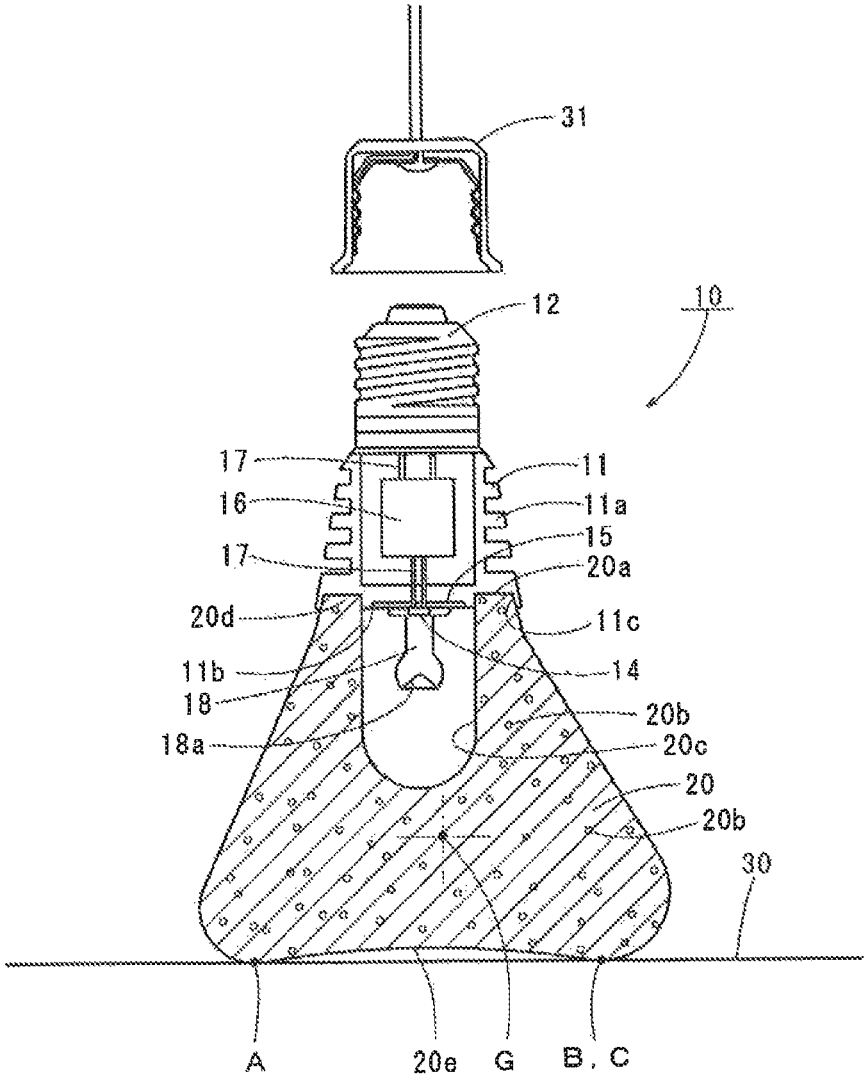
FIG. 1 is a sectional view of an LED lamp according to a first embodiment.
Figure 2:
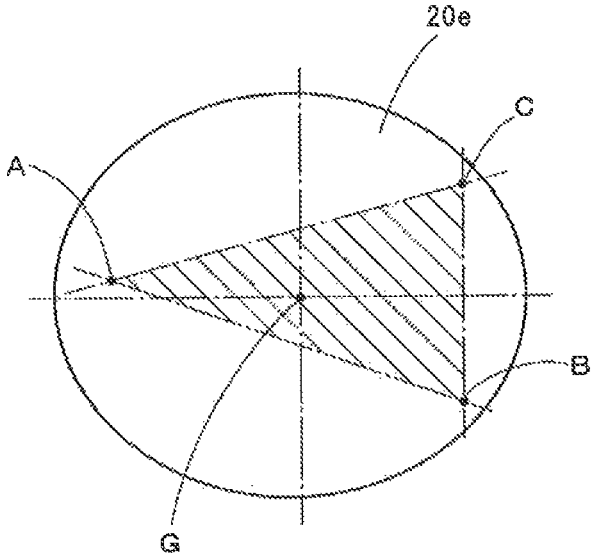
FIG. 2 is an underside view showing the underside of the block of the LED lamp.

Several embodiments will be described with reference to the accompanying drawings. Referring to FIGS. 1 and 2, an LED lamp 10 according to a first embodiment is shown. The LED lamp 10 includes a heat dissipator 11 made of a metal, such as aluminum, having high heat conductivity, a cap 12 mounted to an end of the heat dissipator 11 and having a shape and dimensions in compliance with the International Standard and a block 20 made of glass.

The heat dissipator 11 is formed into the shape of a generally inverted truncated cone. The heat dissipator 11 has an outer periphery formed with a number of fins 11*a* which increase a surface area in order to enhance a heat radiation effect. The heat dissipator 11 has an end surface 11*b* located opposite the cap 12. A module substrate 15 is fixed to the end surface 11*a* of the heat dissipator 11. An LED chip 14 is mounted on the module substrate 15. A lighting circuit 16 is incorporated in the heat dissipator 11 to supply electric power to the LED chip 14. The lighting circuit 16 is electrically connected to the module substrate 15 and to the cap 12 by respective lead wires 17.

A columnar light diffusing member 18 is fixed to the module substrate 15 fixed to the end surface 11*b* of the heat dissipator 11, drooping downward from the end surface 11*b*. The light diffusing member 18 has a distal end formed with a reflecting portion 18*a*. The reflecting portion 18*a* includes a plurality of reflecting surfaces and is formed into an inverted pyramidal shape. The light diffusing member 18 has a proximal end formed with a recess and is mounted to the module substrate 15 so that the LED chip 14 is covered with the recess. Light emitted by the LED chip 14 located opposite the recess is incident through the recess into the light diffusing member 18 and then reflected on the reflecting surfaces of the reflecting portion 18*a* to be diffused around.

The glass block 20 has a flat top 20*a* formed into a right-left asymmetrical angled shape. A number of air bubbles 20*b* are formed in an interior of the block 20. A recess 20*c* having an open end is formed in a central part of the flat top 20*a*. The recess 20*c* extends into the interior of the block 20. A ring-shaped convex strip 20*d* is formed on the open end of the recess 20*c*. The heat dissipator 11 has a ring groove 11*c* formed in the end surface 11*c* thereof. The strip 20*d* of the block 20 is fitted into the ring groove 11*c* and adhered to the ring groove 11*c* by an adhesive agent, whereby the heat dissipator 11 is secured to the flat top 20*a* of the block 20. The end surface of the heat dissipator 11 is located opposite the light diffusing member 18. The cap 12 is mounted to the end surface of the heat dissipator 11 and the heat dissipator is secured to the block so that the heat dissipator and the cap are exposed outside the block, as shown in FIG. 1. The light diffusing member 18 is accommodated through the open end into the recess 20*c*.

Figure 3:
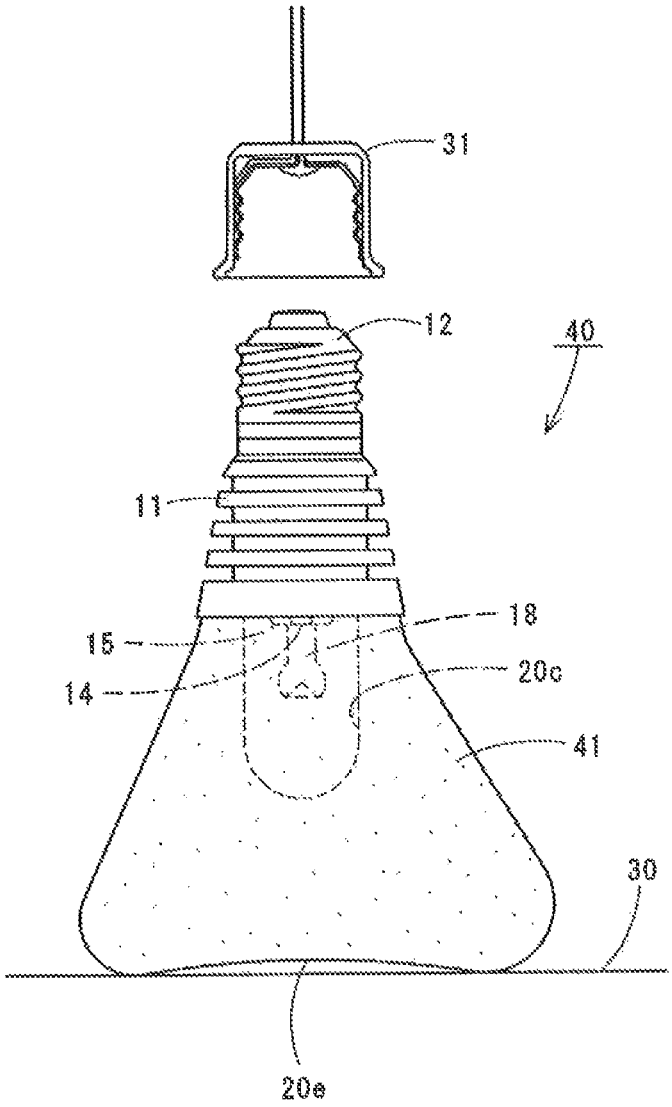
FIG. 3 is a front view of an LED lamp according to a second embodiment.

The block 20 has an underside having a central part formed into a generally flat surface 20*e* gently curved inward so that the underside is placed on a placement surface 30 with three points A, B and C in contact with the placement surface 30 when the block 20 is placed on the placement surface 30, as shown in FIG. 3. Since the block 20 is a handmade component, the block 20 has a right-left asymmetrical irregular shape, whereupon a right half of the block 20 has a larger weight than a left half thereof. Accordingly, the LED lamp 10 including the block 20 has a gravity center G that is positioned near the underside 20*e* of the block 20 and is decentered rightward from an extension of the centerline of the recess 20*c*. The gravity center G of the LED lamp 10 is also positioned inside an imaginary triangle having apexes as three points A, B and C in contact with the placement surface 30.

In use of the LED lamp 10 having the above-described structure, when placed on the placement surface 30, the block 20 is brought into contact with the placement surface 30 at the three points A, B and C and the LED lamp 10 stands by itself under the weight of the block 20 in such a manner that the cap 12 is prevented from contacting the placement surface 30. When a socket 31 is connected to the cap 12 and the lighting circuit 16 is energized via the cap 12, light is emitted by the LED chip 14 and diffused around by the light diffusing member 18 accommodated in the recess 20*c*. The diffused light passes through the glass block 20 to light up around the block 20.

Since the LED chip 14 serving as the light source of the LED lamp 10 has an exceedingly lower calorific value during a turn-on time thereof, there is no possibility that the surface of a floor or table or a rug on the floor or table would be damaged by heat generated by the LED chip 14. Consequently, the LED lamp 10 can be used as interior lighting equipment when placed on the floor, table or a rack to be caused to stand by itself. This can expand use applications of the LED lamp 10.

The block 20 is brought into contact with the placement surface 30 at the three points A, B and C when placed on the placement surface 30. Consequently, the LED lamp 10 can stably stand by itself.

The block 20 has the air bubbles 20*b* formed in the interior thereof. Light emitted by the LED chip 14 is diffused by the light diffusing member 18 thereby to be irregularly reflected on the bubbles 20*b* in the block 20 when passing through the block 20. This can improve the illumination effect.

The heat dissipator 11 is assembled to the handmade block 20 in the LED lamp 10. Accordingly, the user can make the LED lamp 10 with a design according to his or her own taste. This can expand use applications of the LED lamp 10.

FIG. 3 illustrates an LED lamp 40 according to a second embodiment. The LED lamp 40 includes a glass block 41 having a surface which is pearskin-finished by sandblasting. The other configuration of the LED lamp 40 is the same as that of the LED lamp 10 according to the first embodiment. Accordingly, identical or similar parts in the second embodiment are labeled by the same reference symbols as those in the first embodiment and the description of these parts are eliminated.

According to the LED lamp 40 structured as described above, light emitted by the LED chip 14 is diffused by the light diffusing member 18 thereby to be irregularly reflected on the pearskin-finished surface of the block 41 when passing through the block 41. This can improve the illumination effect.

Figure 4:
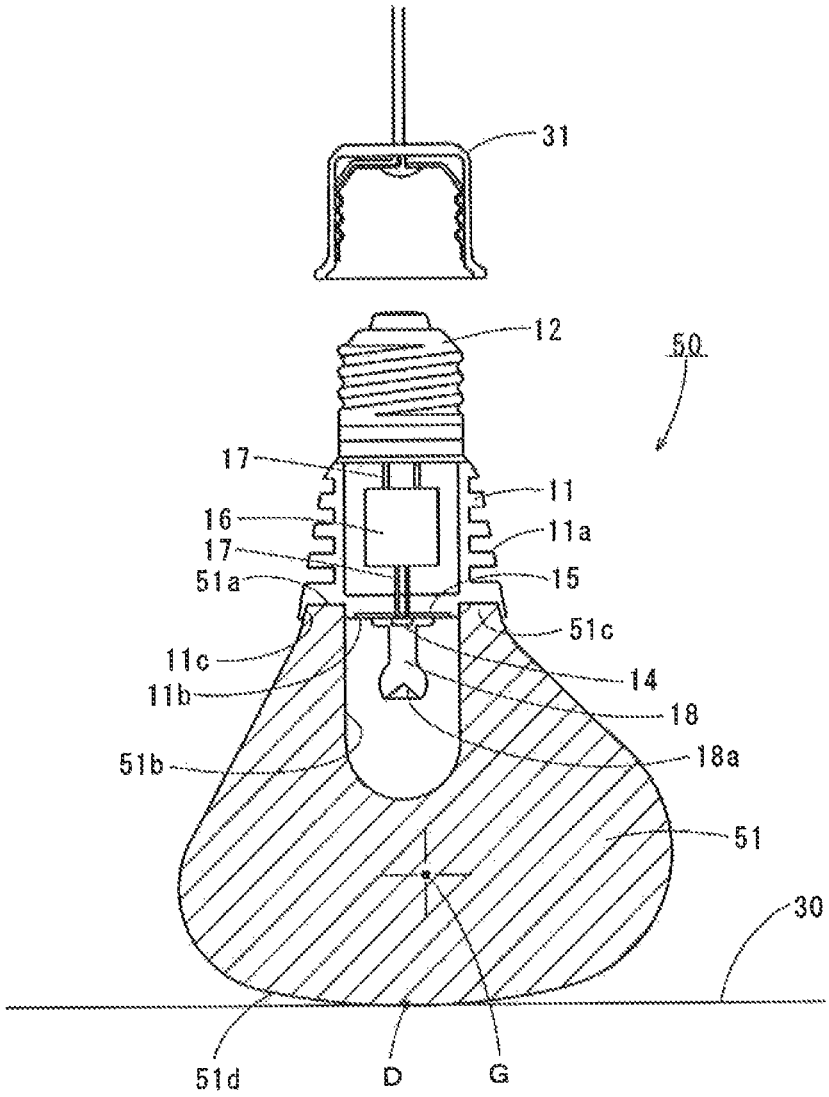
FIG. 4 is a sectional view of an LED lamp according to a third embodiment.

FIG. 4 illustrates an LED lamp 50 according to a third embodiment. The LED lamp 50 includes a block 51 having a flat top 51*a* formed with a centrally located recess 51*b*. The recess 51*b* extends into the interior of the block 51. A ring-shaped convex strip 51*c* is formed on the open end of the recess 51*b*. The strip 51*c* is fitted into the ring groove 11*c* and adhered to the ring groove 11*c* by the adhesive agent, whereby the heat dissipator 11 is secured to the flat top 51*a* of the block 51. The block 51 has the underside 51*d* which is formed into an outwardly gently curved surface so that the LED lamp 50 stands by itself while the block 51 is substantially in a one-point contact with the placement surface 30 when the underside 51*d* of the block 51 is placed on the placement surface 30.

The other configuration of the LED lamp 50 is the same as that of the LED lamp 10 according to the first embodiment. Accordingly, identical or similar parts in the third embodiment are labeled by the same reference symbols as those in the first embodiment and the description of these parts are eliminated.

According to the LED lamp 50 structured as described above, since the block 51 is brought substantially into a one-point contact with the placement surface 30, the LED lamp 50 can stand by itself so as to be swingable in the front-back direction and in the right-left direction about the contact point. A dynamic illumination effect can be achieved when the LED lamp 50 is swung. This can further expand use applications of the LED lamp as interior accessory.

Figure 5:
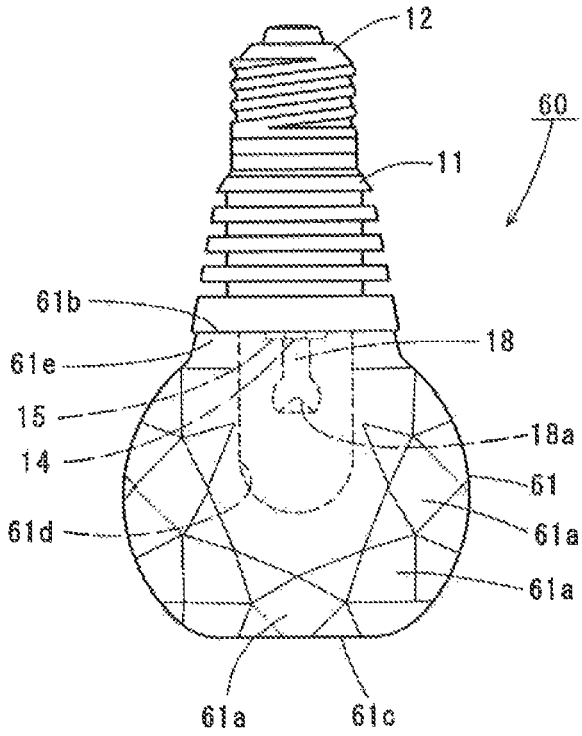
FIG. 5 is a front view of an LED lamp according to a fourth embodiment.

FIG. 5 illustrates an LED lamp 60 according to a fourth embodiment. A glass block 61 of the LED lamp 60 has a surface formed into a large number of facets 61*a*. The block 61 also has a generally flat top 61*b* and a generally flat underside 61*c*. The flat top 61*b* is formed with a centrally located recess 61*d*. The recess 61*d* extends into the interior of the block 61. A ring-shaped convex strip 61*e* is formed on the open end of the recess 61*d*. The strip 61*e* is fitted into the ring groove 11*c* of the heat dissipator 11 and adhered to the ring groove 11*c* by the adhesive agent, whereby the heat dissipator 11 is secured to the flat top 61*b* of the block 60.

The other configuration of the LED lamp 50 is the same as that of the LED lamp 10 according to the first embodiment. Accordingly, identical or similar parts in the third embodiment are labeled by the same reference symbols as those in the first embodiment and the description of these parts are eliminated.

According to the LED lamp 60 structured as described above, light emitted by the LED chip 14 is diffused by the light diffusing member 18 thereby to be irregularly reflected on the facets 61*a* of the block 61 when passing through the block 61. This can improve the illumination effect.

Although the surface of the block 40 is pearskin-finished by sandblasting in the second embodiment, the surface of the block 40 may be formed with a large number of convex and concave portions or grooves, instead. Alternatively, the surface of the block 40 may be colored or formed with one or more drawing patterns.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An LED lamp comprising:

a heat dissipator;

a cap fixed to an end of the heat dissipator;

a module substrate which is fixed to an end of the heat dissipator and on which an LED chip is mounted, said end to which the module substrate is fixed being located opposite the cap;

a light diffusing member which is mounted on an end surface of the heat dissipator so as to be located opposite the LED chip, the light diffusing member peripherally diffusing light emitted by the LED chip;

a lighting circuit which is incorporated in the heat dissipator to supply electric power to the LED chip, the lighting circuit being electrically connected to each one of the cap and the module substrate; and a glass block having an open end and formed with a recess, wherein the light diffusing member is accommodated in the recess of the glass block through the open end of the glass block, and the heat dissipator is secured to the block so that the heat dissipator and the cap are exposed outside the block; and when the block is placed on a placement surface for the LED lamp, the LED lamp stands by itself under weight of the block in such a manner that the cap is prevented from contacting the placement surface.

2. The LED lamp according to claim 1, wherein the block has an underside which is formed to be flat so that the LED lamp stands by itself when the underside of the block is placed on the placement surface.

3. The LED lamp according to claim 1, wherein the underside of the block is gently curved outward so that the LED lamp stands by itself while the block is substantially in a one-point contact with the placement surface of the LED lamp when the underside of the block is placed on the placement surface.

4. The LED lamp according to claim 1, wherein the block is filled with gas bubbles therein.

5. The LED lamp according to claim 1, wherein the block has a surface formed with a number of facets.

6. The LED lamp according to claim 1, wherein the block has a surface roughened so that light emitted by the LED chip is diffusely reflected on the surface of the block.

* * * * *